US011605913B2

(12) United States Patent
Miyamoto et al.

(10) Patent No.: US 11,605,913 B2
(45) Date of Patent: Mar. 14, 2023

(54) CONNECTOR AND MANUFACTURING METHOD OF CONNECTOR

(71) Applicant: KYOCERA CORPORATION, Kyoto (JP)

(72) Inventors: Kenji Miyamoto, Yokohama (JP); Munenobu Yoshida, Yamato (JP)

(73) Assignee: KYOCERA CORPORATION, Kyoto (JP)

( * ) Notice: Subject to any disclaimer, the term of this patent is extended or adjusted under 35 U.S.C. 154(b) by 8 days.

(21) Appl. No.: 17/287,032

(22) PCT Filed: Oct. 3, 2019

(86) PCT No.: PCT/JP2019/039189
§ 371 (c)(1),
(2) Date: Apr. 20, 2021

(87) PCT Pub. No.: WO2020/085036
PCT Pub. Date: Apr. 30, 2020

(65) Prior Publication Data

US 2021/0384663 A1 Dec. 9, 2021

(30) Foreign Application Priority Data

Oct. 23, 2018 (JP) ..... JP2018-199331

(51) Int. Cl.
*H01R 12/91* (2011.01)
*H01R 12/73* (2011.01)
*H01R 43/20* (2006.01)

(52) U.S. Cl.
CPC ..... *H01R 12/91* (2013.01); *H01R 12/73* (2013.01); *H01R 43/20* (2013.01)

(58) Field of Classification Search
CPC .... H01R 13/24; H01R 13/6315; H01R 12/91; H01R 12/73
See application file for complete search history.

(56) References Cited

U.S. PATENT DOCUMENTS 6,609,922 B2 * 8/2003 Torii ..... H01R 13/6315 439/247
7,887,350 B2 * 2/2011 Fukazawa ..... H01R 12/707 439/247
8,485,831 B2 * 7/2013 Cipolla ..... H01R 13/514 439/74

(Continued)

FOREIGN PATENT DOCUMENTS

JP 2015-035352 A 2/2015

*Primary Examiner* — Neil Abrams
(74) *Attorney, Agent, or Firm* — Duane Morris LLP

(57) ABSTRACT

A connector includes a plurality of contacts. Each of the contacts includes a first engagement portion, a second engagement portion, a first bent portion, a second bent portion, and a coupling portion. A second angle formed by a reference straight line and a second straight line is smaller than a first angle formed by the reference straight line and a first straight line, where the first straight line is a straight line passing through an end of the first bent portion on the first engagement portion side and an end of the first bent portion on the coupling portion side, and the second straight line is a straight line passing through an end of the second bent portion on the coupling portion side and an end of the second bent portion on the second engagement portion side.

12 Claims, 15 Drawing Sheets

(56) References Cited

U.S. PATENT DOCUMENTS

| | | | | |
|---|---|---|---|---|
| 9,484,656 | B2 * | 11/2016 | Doi | H01R 12/716 |
| 10,707,619 | B2 * | 7/2020 | Suzuki | H01R 13/6315 |
| 11,381,019 | B2 * | 7/2022 | Morita | H01R 12/716 |
| 2016/0204536 | A1 | 7/2016 | Doi et al. | |
| 2021/0384663 | A1 * | 12/2021 | Miyamoto | H01R 12/73 |

* cited by examiner

CONNECTOR AND MANUFACTURING METHOD OF CONNECTOR

CROSS-REFERENCE TO RELATED APPLICATIONS

This application is a National Stage of PCT international application Ser. No. PCT/JP2019/039189 filed on Oct. 3, 2019 which designates the United States, incorporated herein by reference, and which is based upon and claims the benefit of priority from Japanese Patent Application No. 2018-199331 filed on Oct. 23, 2018, the entire contents of which are incorporated herein by reference.

FIELD

The present disclosure relates to a connector and a manufacturing method of the connector.

BACKGROUND

Connectors to connect two substrates have been known. A connector attached to one substrate is connected to a connector attached to the other substrate. However, relative positions of the two connectors may deviate from relative positions at a time of designing. In this case, there is a possibility that the two connectors do not fit properly. On the other hand, there has been known a floating connector that can be properly connected to another connector even in a case where positions of the two connectors are deviated. Patent Literature 1 discloses an example of a floating connector.

CITATION LIST

Patent Literature

Patent Literature 1: Japanese Patent Application Laid-open No. 2015-35352

SUMMARY

A connector according to an aspect of embodiments that is connected to another connector and includes: a fixed insulator that is provided with a plurality of first fixing grooves extending in a first direction and arranged in a second direction orthogonal to the first direction; a movable insulator that is provided with a plurality of second fixing grooves extending in the first direction and arranged in the second direction, that is disposed inside the fixed insulator, and that is movable with respect to the fixed insulator; and a plurality of contacts that are engaged with the fixed insulator and the movable insulator and each of which includes a first contact portion that is in contact with the other connector. Each of the contacts includes a first engagement portion engaged with the fixed insulator, a second engagement portion engaged with the movable insulator, a first bent portion that is coupled to the first engagement portion and is placed between the first engagement portion and the second engagement portion, a second bent portion that is coupled to the second engagement portion and is placed on the second engagement portion side with respect to the first bent portion, and a coupling portion that couples the first bent portion and the second bent portion. The first engagement portion, the first bent portion, the coupling portion, the second bent portion, and the second engagement portion are arranged in a connecting direction in which the connector and the other connector are connected. A second angle formed by a second straight line and a reference straight line parallel to the connecting direction is smaller than a first angle formed by a first straight line and the reference straight line, where the first straight line is a straight line passing through an end of the first bent portion on the first engagement portion side and an end of the first bent portion on the coupling portion side in an array direction in which the contacts are arrayed, and the second straight line is a straight line passing through an end of the second bent portion on the coupling portion side and an end of the second bent portion on the second engagement portion side in the array direction.

DESCRIPTION OF EMBODIMENTS

Figure 1:
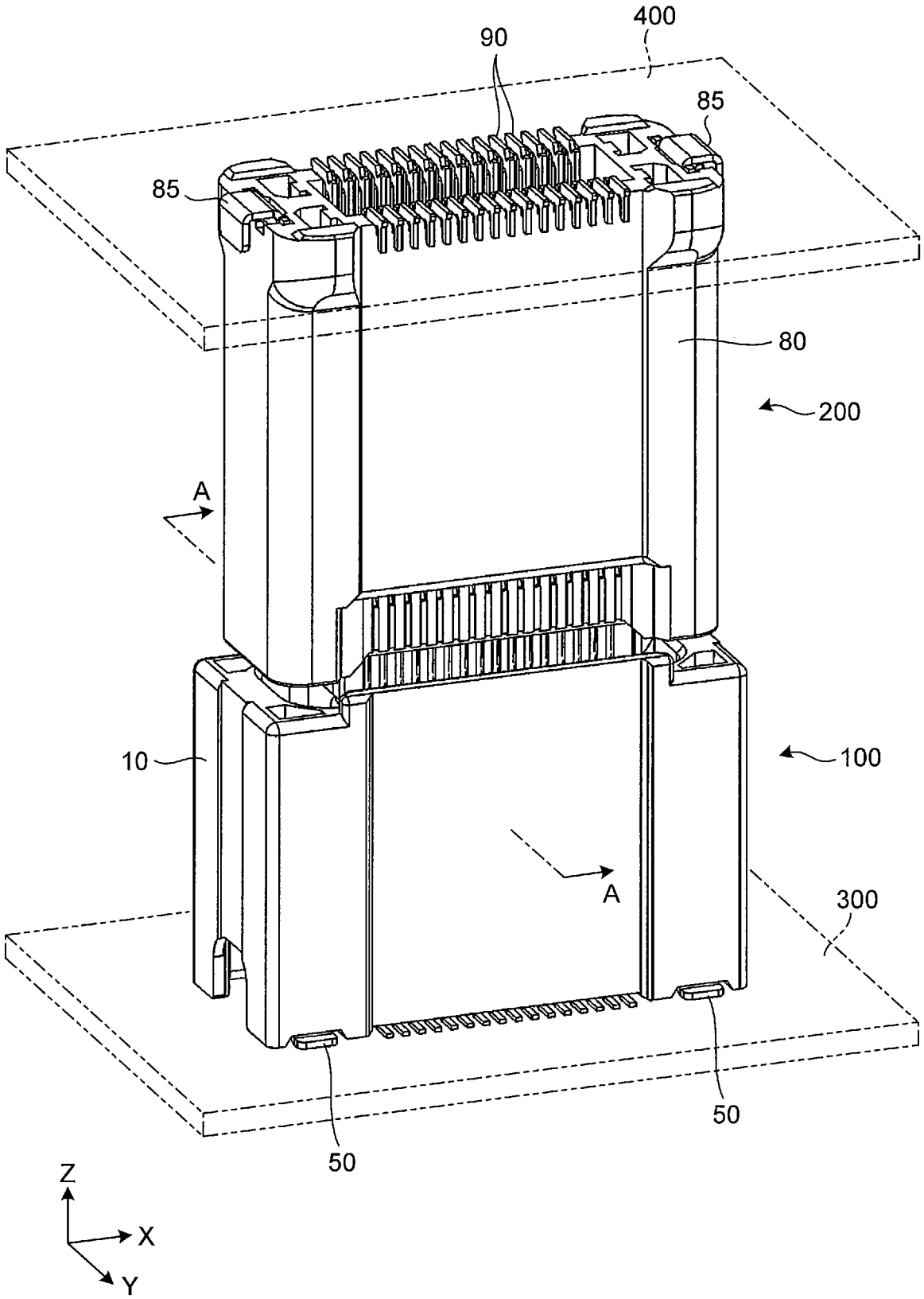
FIG. 1 is a perspective view of a connector of an embodiment and another connector after connecting.

In the following, embodiments of a connector of the present disclosure will be described with reference to the drawings. The invention is not limited to these embodiments. Components in the following embodiments include what can be easily replaced by those skilled in the art, or what is substantially the same.

In the following description, an XYZ Cartesian coordinate system is used. An X-axis is an axis parallel to a direction in which a plurality of contacts 30 are arranged. A Z-axis is an axis parallel to a relative moving direction in which a connector 100 and a connector 200 are connected (connecting direction). A Y-axis is an axis orthogonal to both of the X-axis and the Z-axis. An XY plane is parallel to a substrate 300 and a substrate 400. The Z-axis is orthogonal to the substrate 300 and the substrate 400. A direction along the X-axis is described as an X direction, a direction along the Y-axis is described as a Y direction, and a direction along the Z-axis is described as a Z direction. In the Z direction, it is assumed that a direction from the connector 100 toward the connector 200 is a +Z direction, and a direction opposite to the +Z direction is a −Z direction.

The X direction is a direction in which the plurality of contacts 30 are arranged. The X direction is an array direction in which the plurality of contacts 30 are arrayed. It can be also said that the X direction is a short-side direction of a fixed insulator 10 in a planar view orthogonal to the substrate 300 and the substrate 400. The Y direction is a direction parallel to the substrate 300 and the substrate 400 and orthogonal to the direction in which the plurality of contacts 30 are arranged. It can be also said that the Y direction is a long-side direction of the fixed insulator 10 in a planar view orthogonal to the substrate 300 and the substrate 400. The Z direction is a relative moving direction in which the connector 100 and the connector 200 are connected (connecting direction). It can be also said that the Z direction is a direction orthogonal to the substrate 300 and the substrate 400.

Embodiment

Figure 2:
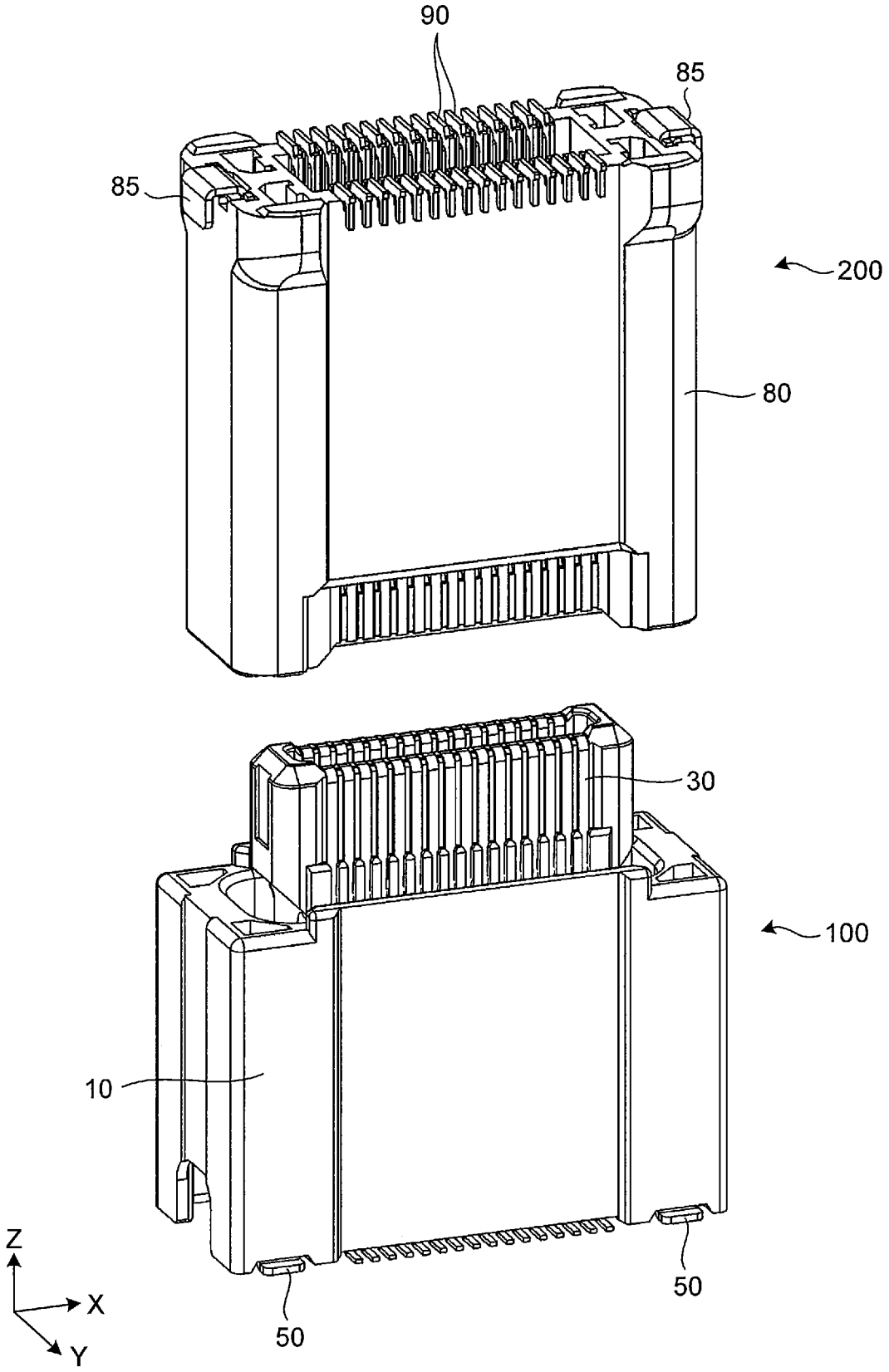
FIG. 2 is a perspective view of the connector of the embodiment and the other connector before the connecting.
Figure 3:
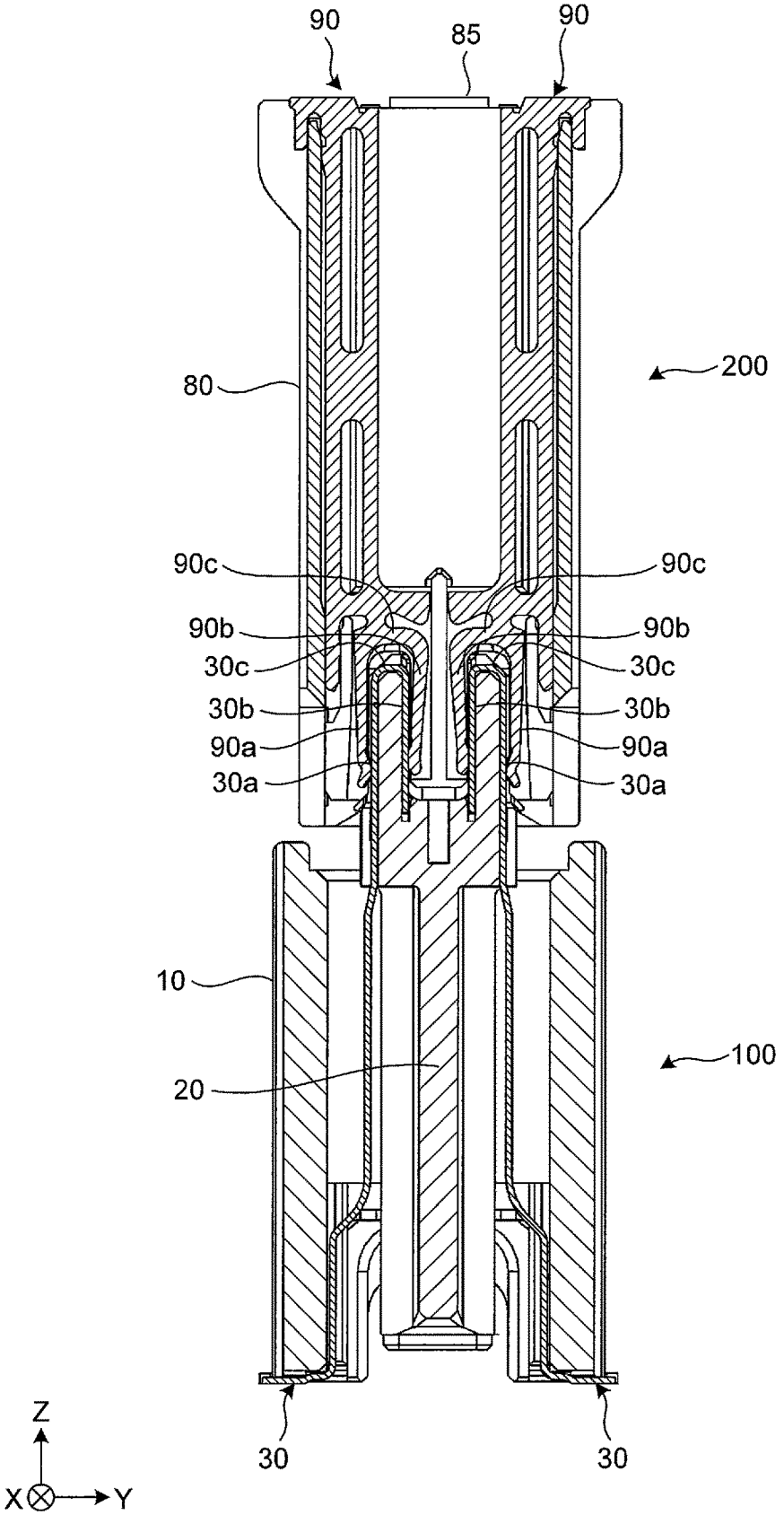
FIG. 3 is a cross-sectional view taken along a line A-A of FIG. 1.

FIG. 1 is a perspective view of a connector of an embodiment and another connector. FIG. 2 is an exploded perspective view of the connector of the embodiment and the other connector. FIG. 3 is a cross-sectional view of the connector of the embodiment and the other connector.

As illustrated in FIG. 1, the connector 100 of the embodiment is attached to the substrate 300. The connector 100 is connected to the other connector 200. The connector 200 is attached to the substrate 400. The substrate 300 and the substrate 400 are connected via the connector 100 and the connector 200. The substrate 300 and the substrate 400 are printed circuit boards and are provided with a plurality of electronic components. The substrate 300 and the substrate 400 may be flexible printed circuits (FPC).

As illustrated in FIG. 2, the connector 100 includes a fixed insulator 10, a fixture 50, a movable insulator 20, and a plurality of contacts 30. The fixed insulator 10 has a frame shape. The fixed insulator 10 is attached to the substrate 300 via the fixture 50 and the contacts 30 by soldering or the like. The fixture 50 is disposed inside the fixed insulator 10. The fixture 50 is fixed to the substrate 300 by soldering or the like. The movable insulator 20 is disposed inside the fixed insulator 10. The movable insulator 20 is attached to the fixed insulator 10 via the contacts 30. The movable insulator 20 can be moved with respect to the fixed insulator 10 by elastic deformation of the contacts 30. The contacts 30 are fixed to the substrate 300 by soldering or the like. The plurality of contacts 30 are arranged in one direction.

As illustrated in FIG. 3, each of the contacts 30 includes a first contact portion 30*a*, a second contact portion 30*b*, and a coupling portion 30*c*. The first contact portion 30*a* is disposed with a gap between the first contact portion 30*a* and the second contact portion 30*b*. The coupling portion 30*c* is curved and couples one end of the first contact portion 30*a* and one end of the second contact portion 30*b*. The first contact portion 30*a*, the second contact portion 30*b*, and the coupling portion 30*c* are arranged in such a manner as to form a substantially U shape.

As illustrated in FIG. 2, the connector 200 includes an insulator 80, a fixture 85, and a plurality of contacts 90. The insulator 80 has a frame shape. The insulator 80 is attached to the substrate 400 by soldering or the like via the fixture 85 and the contacts 90. The fixture 85 is disposed at an end of the insulator 80. The contacts 90 are fixed to the substrate 400 by soldering or the like. The plurality of contacts 90 are arranged in one direction.

As illustrated in FIG. 3, each of the contacts 90 includes a first contact portion 90*a*, a second contact portion 90*b*, and a coupling portion 90*c*. The first contact portion 90*a* is disposed with a gap between the first contact portion 90*a* and the second contact portion 90*b*. The coupling portion 90*c* is curved and couples one end of the first contact portion 90*a* and one end of the second contact portion 90*b*. The first contact portion 90*a*, the second contact portion 90*b*, and the coupling portion 90*c* are arranged in such a manner as to form a substantially U shape.

As illustrated in FIG. 3, the contacts 90 are in contact with the contacts 30. The first contact portion 90*a* and the second contact portion 90*b* of the contact 90 sandwich the first contact portion 30*a* and the second contact portion 30*b* of the contact 30. The first contact portion 90*a* is in contact with the first contact portion 30*a*. The second contact portion 90*b* is in contact with the second contact portion 30*b*. That is, the contact 90 and the contact 30 are in contact with each other at two points. The contact between the contact 90 and the contact 30 causes the substrate 300 and the substrate 400 to be electrically connected to each other. Since the contact 90 and the contact 30 are in contact with each other at two points, contact reliability is improved. That is, conduction failure between the substrate 300 and the substrate 400 is hampered. In the Z direction, a gap is provided between the coupling portion 30*c* and the coupling portion 90*c*.

When being connected, the connector 100 and the connector 200 may possibly be deviated from each other. At that time, force is applied from the connector 200 to the movable insulator 20 connected into the connector 200. Simultaneously, the contacts 30 engaged with the movable insulator 20 are pushed to some extent by the contacts 90 engaged with the insulator 80. Thus, when force is applied indirectly to contact portions between the contacts 30 and the substrate 300, the contact portions between the contacts 30 and the substrate 300 may possibly be damaged. In the connector 100 of the present embodiment, the movable insulator 20 that is engaged with the contacts 30 is moved with respect to the fixed insulator 10 by elastic portions of the contacts 30. Thus, force that would be generated at the contact portions between the contacts 30 and the substrate 300 is reduced. Since a positional deviation of the connector 100 and the connector 200 is accommodated when they are connected, workability can be improved. Such a connector 100 is called a floating connector.

In connecting the substrate 300 and the substrate 400 to each other by using the connector 100 and the connector 200, a mode is provided in which the substrate 300 and the substrate 400 are caused to be connected while being moved in parallel to each other. Thus, when the connector 100 and the connector 200 are being connected or in a connected state, it is preferred that the movable insulator 20 be moved as parallel as possible with respect to a plane orthogonal to the connecting direction of the connector 100 and the other connector 200.

Figure 4:
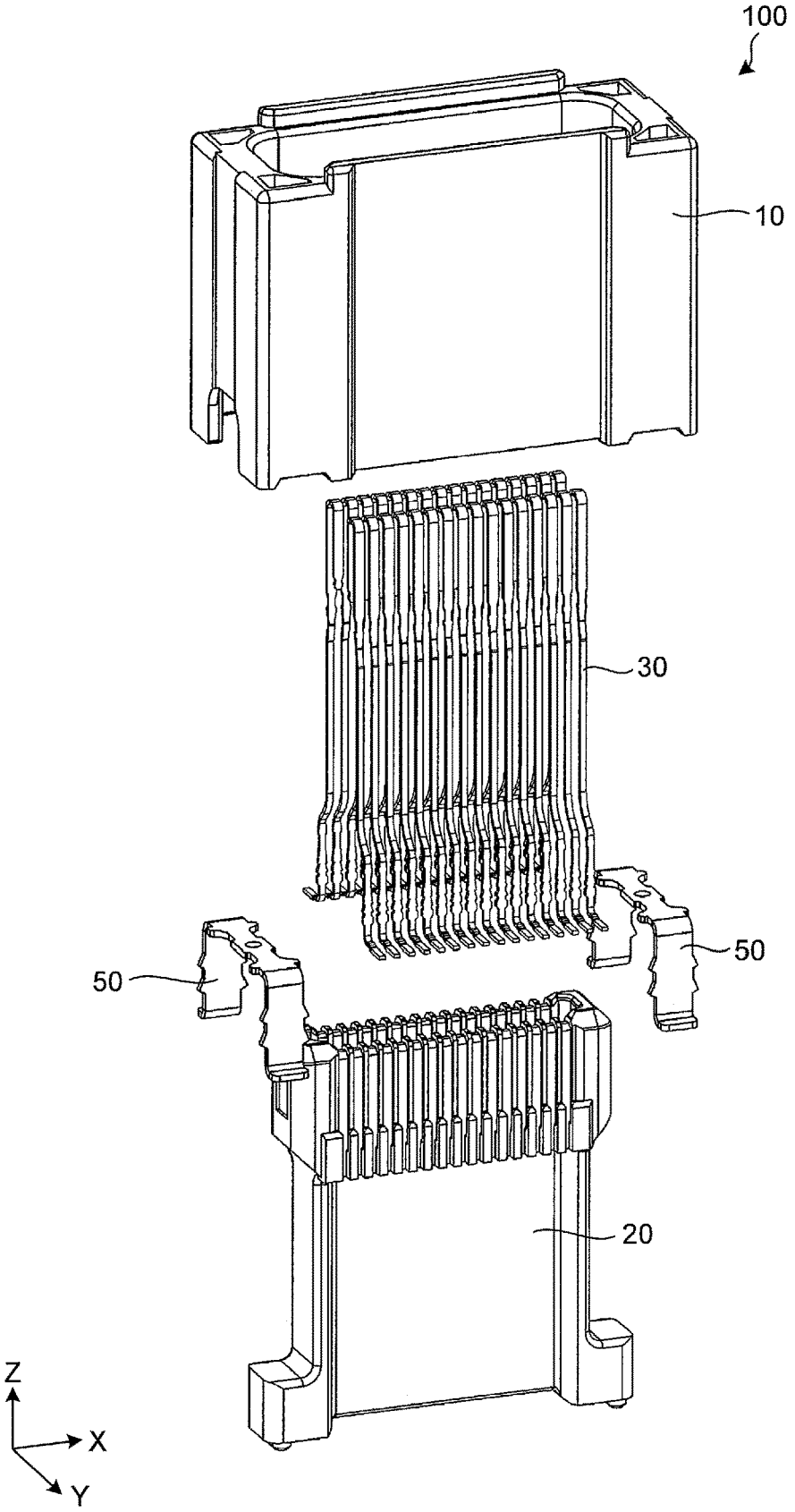
FIG. 4 is an exploded perspective view of the connector of the embodiment.
Figure 5:
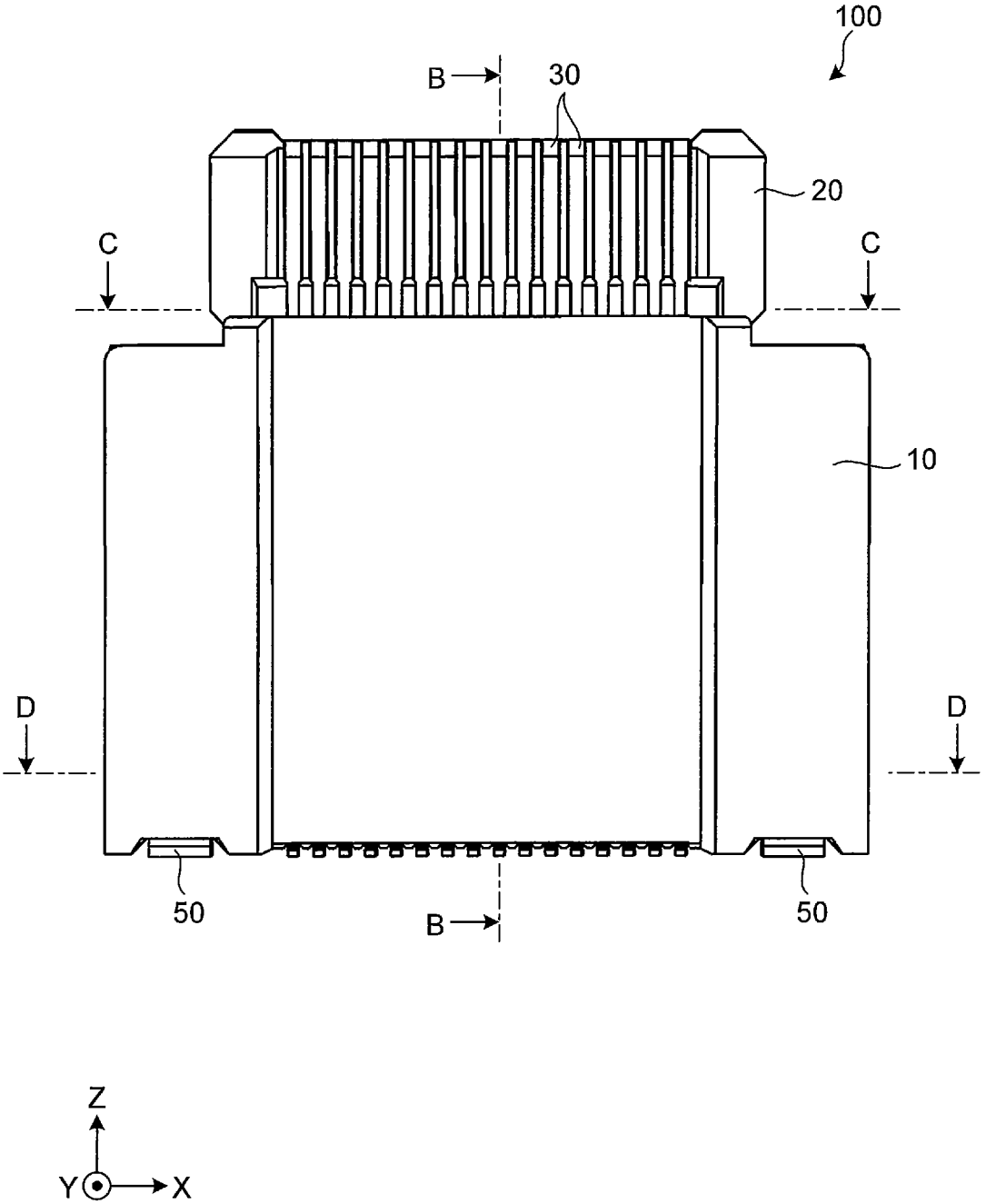
FIG. 5 is a front view of the connector of the embodiment.
Figure 6:
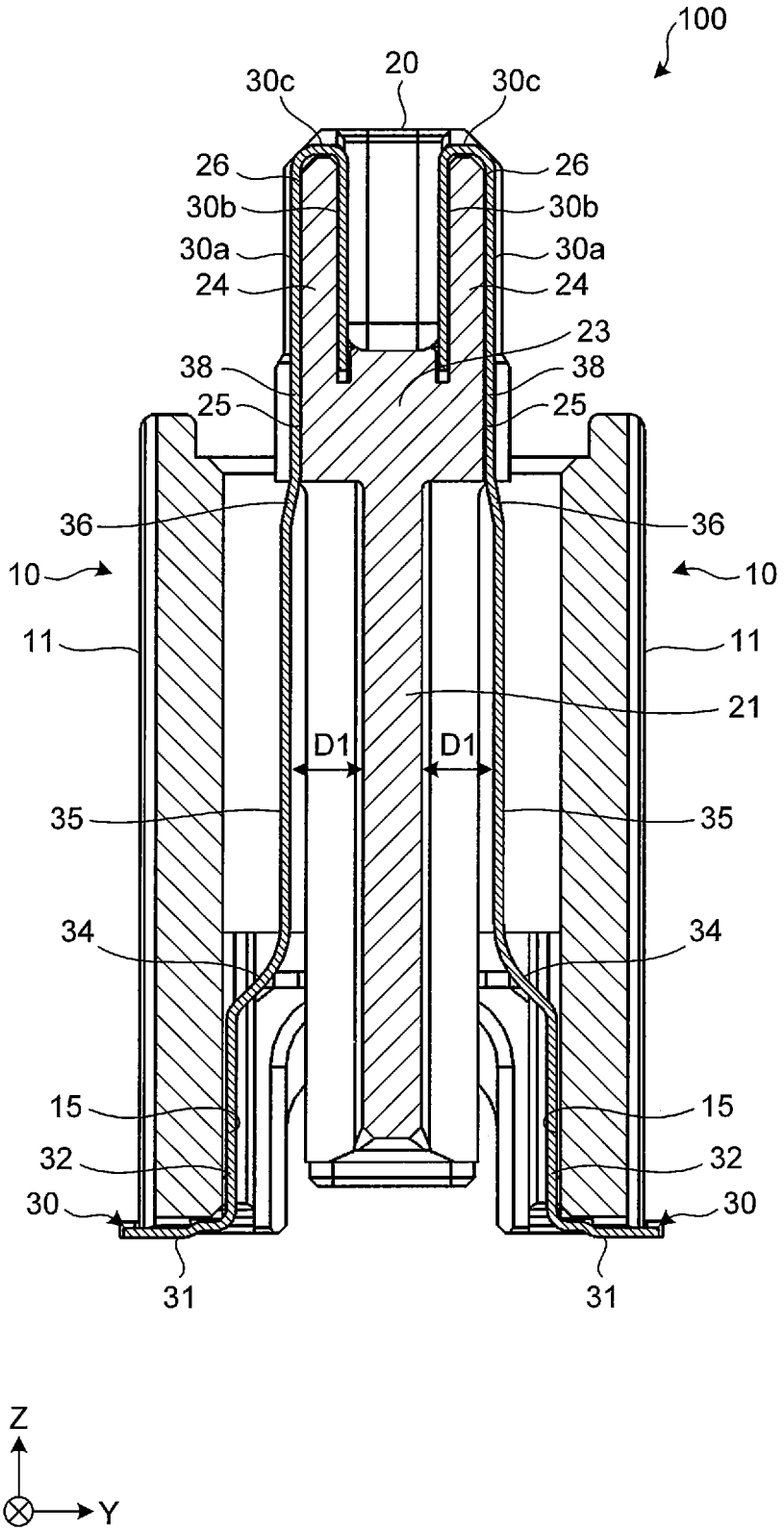
FIG. 6 is a cross-sectional view taken along a line B-B of FIG. 5.
Figure 7:
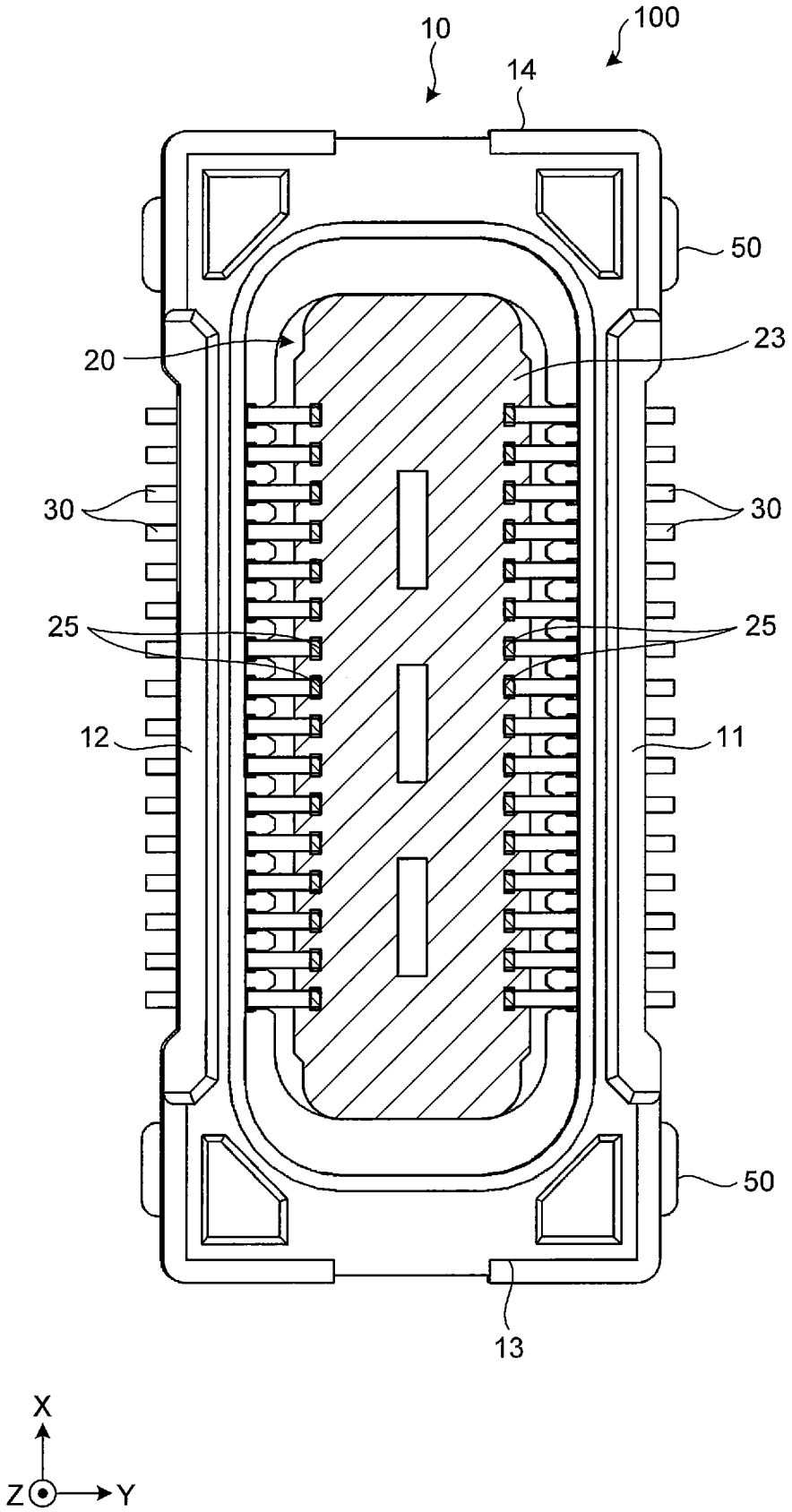
FIG. 7 is a cross-sectional view taken along a line C-C of FIG. 5.
Figure 8:
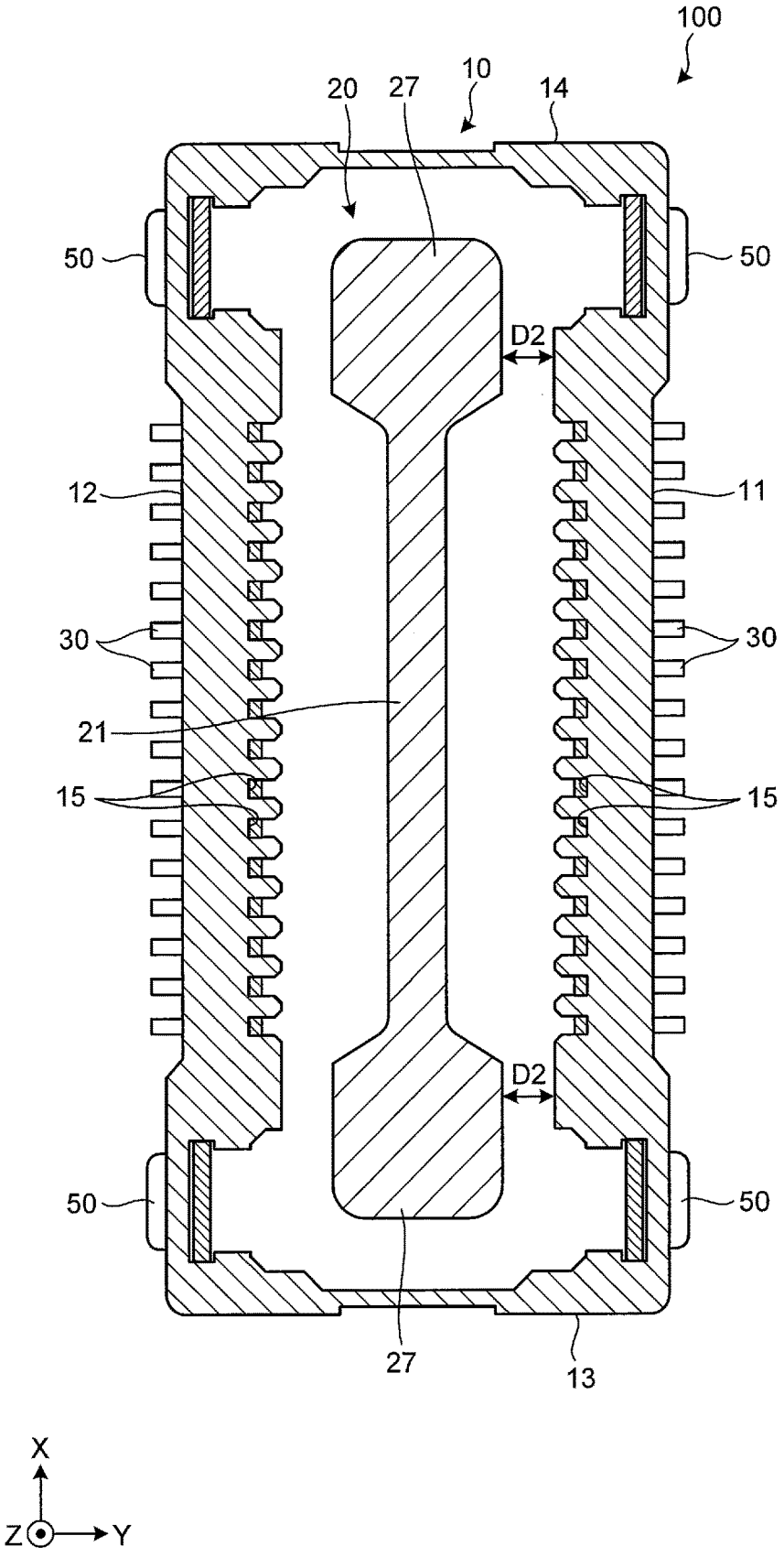
FIG. 8 is a cross-sectional view taken along a line D-D of FIG. 5.
Figure 9:
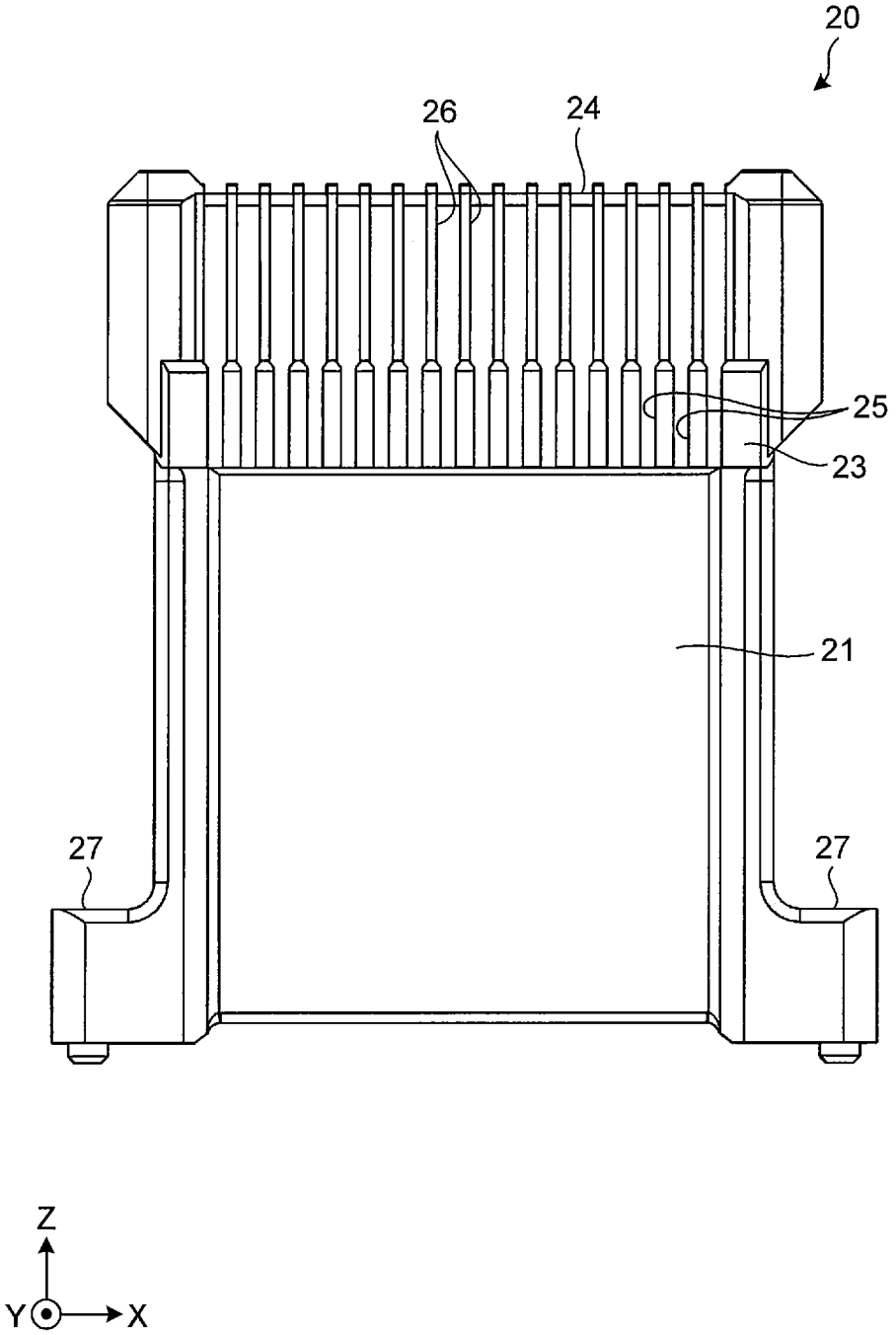
FIG. 9 is a front view of a movable insulator of the embodiment.
Figure 10:
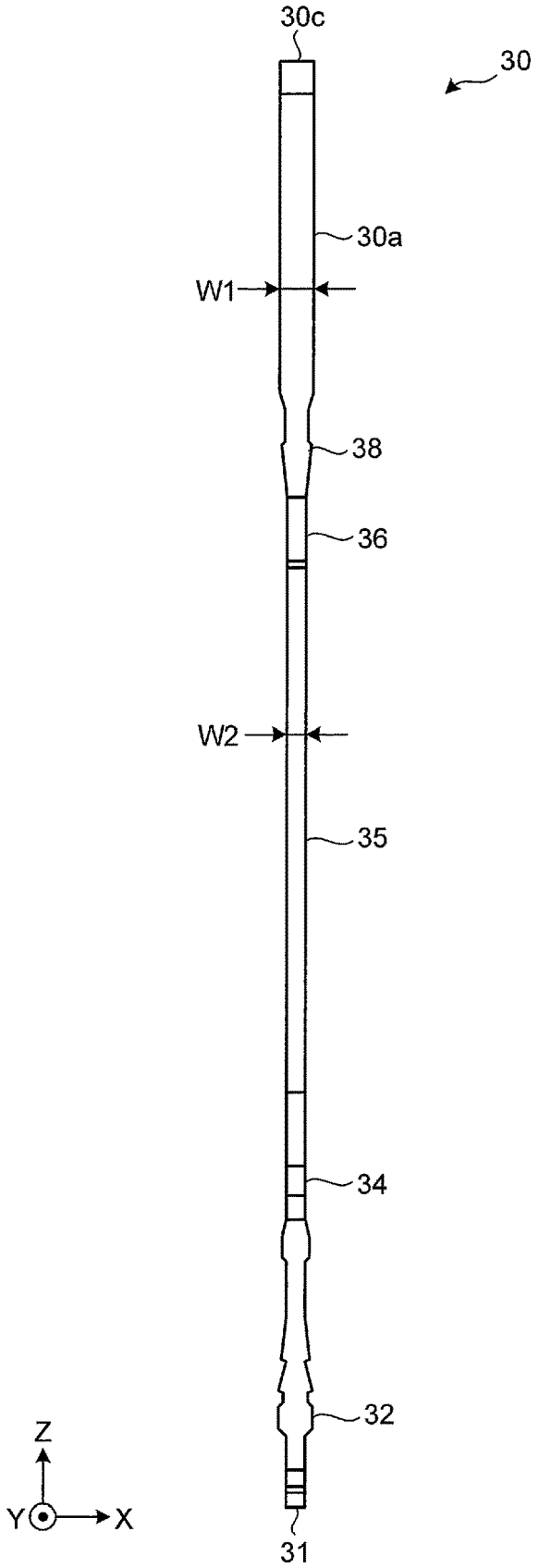
FIG. 10 is a front view of a contact of the embodiment.
Figure 11:
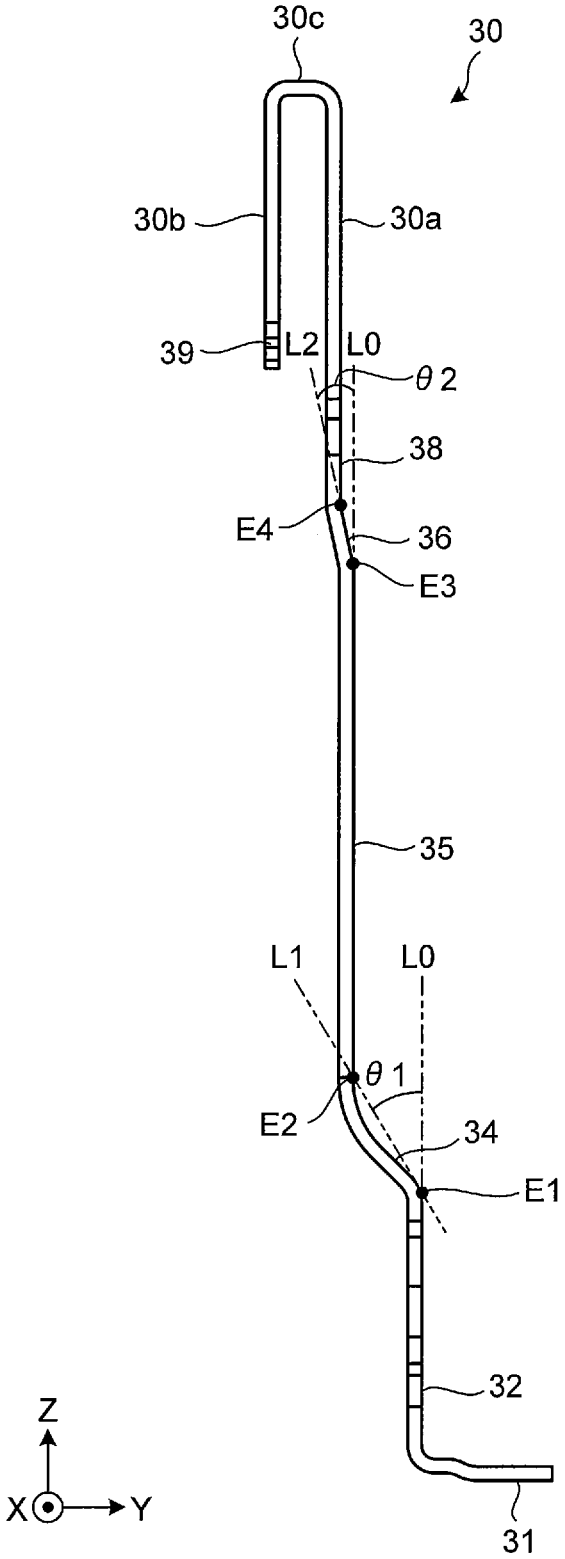
FIG. 11 is a side view of the contact of the embodiment.
Figure 12:
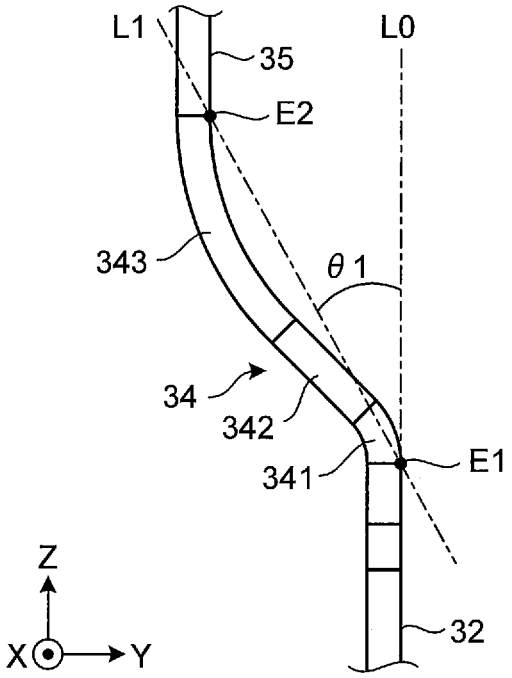
FIG. 12 is an enlarged view of a first bent portion of the contact of the embodiment.
Figure 13:
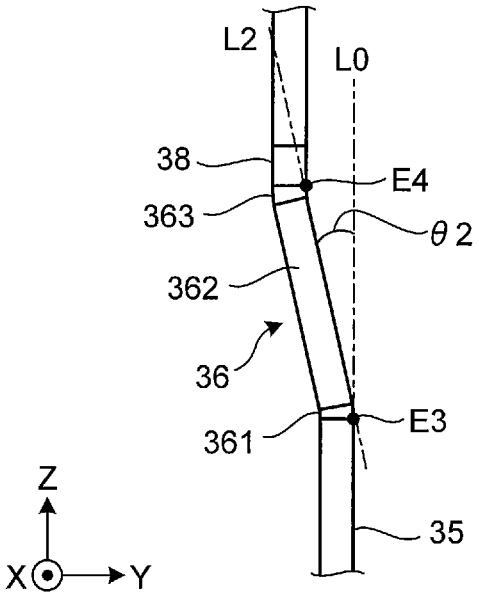
FIG. 13 is an enlarged view of a second bent portion of the contact of the embodiment.

FIG. 4 is an exploded perspective view of the connector of the embodiment. FIG. 5 is a front view of the connector of the embodiment. FIG. 6 is a cross-sectional view taken along a line B-B of FIG. 5. FIG. 7 is a cross-sectional view taken along a line C-C of FIG. 5. FIG. 8 is a cross-sectional view taken along a line D-D of FIG. 5. FIG. 9 is a front view of the movable insulator of the embodiment. FIG. 10 is a front view of a contact of the embodiment. FIG. 11 is a side view of the contact of the embodiment. FIG. 12 is an enlarged view of a first bent portion of the contact of the embodiment. FIG. 13 is an enlarged view of a second bent portion of the contact of the embodiment.

As illustrated in FIG. 7 and FIG. 8, the fixed insulator 10 includes a first side wall 11, a second side wall 12, a third side wall 13, a fourth side wall 14, and a plurality of first fixing grooves 15.

As illustrated in FIG. 7, the first side wall 11 is disposed with a gap in the Y direction between the first side wall 11 and the second side wall 12. The third side wall 13 is disposed with a gap in the X direction between the third side wall 13 and the fourth side wall 14. The third side wall 13 couples one end of the first side wall 11 and one end of the second side wall 12. The fourth side wall 14 couples the other end of the first side wall 11 and the other end of the second side wall 12. The first side wall 11, the second side wall 12, the third side wall 13, and the fourth side wall 14 are arranged in such a manner as to form a rectangle in an XY planar view.

As illustrated in FIG. 6 and FIG. 8, the first fixing grooves 15 are provided on a surface of the first side wall 11 that faces the second side wall 12 and on a surface of the second side wall 12 that faces the first side wall 11. The first fixing grooves 15 extend in the Z direction. A longitudinal direction of each of the first fixing grooves 15 is parallel to the Z direction. The plurality of first fixing grooves 15 are arranged at equal intervals in the X direction.

As illustrated in FIG. 6 and FIG. 8, the movable insulator 20 includes a base 21, a first wide portion 23, two holding portions 24, two second wide portions 27, a plurality of second fixing grooves 25, and a plurality of holding grooves 26.

As illustrated in FIG. 6, the base 21 is disposed inside the fixed insulator 10. The first wide portion 23 is disposed on the +Z direction side of the fixed insulator 10. A part of the first wide portion 23 is exposed from the fixed insulator 10. A width of the first wide portion 23 in the Y direction is greater than a width of the base 21 in the Y direction. The holding portion 24 protrudes in the +Z direction from the first wide portion 23. The two holding portions 24 are arranged with a gap therebetween in the Y direction. As illustrated in FIG. 8, the second wide portions 27 are respectively disposed, at both ends of the base 21 in the X direction. A width of the second wide portions 27 in the Y direction is greater than a width of the base 21 in the Y direction. It is assumed that a smaller one of a distance between the second wide portions 27 and the first side wall 11 in the Y direction and a distance between the second wide portions 27 and the second side wall 12 in the Y direction is D2.

As illustrated in FIG. 9, the second fixing grooves 25 are provided in the first wide portion 23. The second fixing grooves 25 extend in the Z direction. A longitudinal direction of the second fixing grooves 25 is parallel to the Z direction. The plurality of second fixing grooves 25 are arranged at equal intervals in the X direction. The plurality of holding grooves 26 are provided in the holding portion 24. The holding grooves 26 extend in the Z direction. A longitudinal direction of the holding grooves 26 is parallel to the Z direction. The plurality of holding grooves 26 are arranged at equal intervals in the X direction. The holding grooves 26 are connected to the second fixing grooves 25.

As illustrated in FIG. 10 and FIG. 11, each of the contacts 30 includes a mounted portion 31, a first engagement portion 32, a second engagement portion 38, a third engagement portion 39, a first bent portion 34, a second bent portion 36, and a coupling portion 35. The contact 30 is formed by, for example, bending a plate material formed by punching a metal plate with a press. The plate material is bent by force applied in the same direction as a punching direction in which the metal plate is punched. The plate material is bent in such a manner that its surface orthogonal to the punching direction in which the metal plate is punched is curved. That is, the contacts 30 are of a bellows type. The first engagement portion 32, the first bent portion 34, the coupling portion 35, the second bent portion 36, and the second engagement portion 38 are arranged in the connecting direction (Z direction).

As illustrated in FIG. 11, the mounted portion 31 has a plate shape parallel to the XY plane. A thickness direction (plate thickness direction) of the mounted portion 31 is parallel to the Z direction. The thickness direction means a direction orthogonal to a surface having the largest area in the plate-shaped member and is used in the following description as a direction having the same meaning. The mounted portion 31 is fixed to the substrate 300 (see FIG. 1).

As illustrated in FIG. 11, the first engagement portion 32 is disposed on the +Z direction side of the mounted portion 31. The first engagement portion 32 has a plate shape parallel to an XZ plane. A thickness direction of the first engagement portion 32 is parallel to the Y direction. The first engagement portion 32 is engaged with a first fixing groove 15 (see FIG. 8). A width of the first engagement portion 32 in the X direction is greater than a width of the first fixing groove 15 in the X direction. The first engagement portion 32 is press-inserted into the first fixing groove 15. The contacts 30 are positioned by the first engagement portions 32.

As illustrated in FIG. 11, the second engagement portion 38 is disposed on the −Z direction side of the first contact portion 30*a*. The second engagement portion 38 has a plate shape parallel to the XZ plane. A thickness direction of the second engagement portion 38 is parallel to the Y direction. The second engagement portion 38 is engaged with a second fixing groove 25 (see FIG. 9). A width of the second engagement portion 38 in the X direction is greater than a width of the second fixing groove 25 in the X direction. The second engagement portion 38 is press-inserted into the second fixing groove 25. The contacts 30 are positioned by the second engagement portions 38.

As illustrated in FIG. 11, the third engagement portion 39 is disposed on the −Z direction side of the second contact portion 30*b*. The third engagement portion 39 has a plate shape parallel to the XZ plane. A thickness direction of the third engagement portion 39 is parallel to the Y direction. The third engagement portion 39 is engaged with a holding groove 26 (see FIG. 9). A width of the third engagement portion 39 in the X direction is greater than a width of the holding groove 26 in the X direction. The third engagement portion 39 is press-inserted into the holding groove 26. The contacts 30 are positioned by the third engagement portions 39.

As illustrated in FIG. 11, the first bent portion 34 is coupled to the first engagement portion 32. The first bent portion 34 is disposed between the first engagement portion 32 and the second engagement portion 38. The first bent portion 34 has a plate shape bent in the Y direction. The first bent portion 34 is bent in such a manner as to become closer to the movable insulator 20 in the +Z direction. As illustrated in FIG. 6, a distance in the Y direction from an end of the first bent portion 34 on the first engagement portion 32 side (−Z direction side) to the movable insulator 20 is longer than a distance in the Y direction from an end of the first bent portion 34 on the second engagement portion 38 side (+Z direction side) to the movable insulator 20.

As illustrated in FIG. 12, the first bent portion 34 includes a first curved portion 341, a flat portion 342, and a second curved portion 343. The first curved portion 341, the flat portion 342, and the second curved portion 343 are arranged in the +Z direction in the order as listed. A surface of the first curved portion 341 that faces the movable insulator 20 has a curved surface shape that is recessed with respect to the movable insulator 20. A surface of the flat portion 342 that faces the movable insulator 20 has a flat surface shape inclined with respect to the XY plane. A surface of the second curved portion 343 that faces the movable insulator 20 has a curved surface shape that is protruded with respect to the movable insulator 20.

The first bent portion 34 can be elastically deformed. The movable insulator 20 can be moved with respect to the fixed insulator 10 by the elastic deformation of the first bent portion 34. This reduces stress that would be generated in the mounted portion 31 and the substrate 300 when the connector 100 is being connected to the other connector 200 or in a connected state thereto.

As illustrated in FIG. 11, the second bent portion 36 is coupled to the second engagement portion 38. The second bent portion 36 is disposed between the first engagement portion 32 and the second engagement portion 38. The second bent portion 36 is disposed on the second engagement portion 38 side with respect to the first bent portion 34. The second bent portion 36 has a bent plate shape. The second bent portion 36 is bent in such a manner as to become closer to the movable insulator 20 in the +Z direction. As illustrated in FIG. 6, a distance in the Y direction from an end of the second bent portion 36 on the first engagement portion 32 side (−Z direction side) to the movable insulator 20 is longer than a distance in the Y direction from an end of the second bent portion 36 on the second engagement portion 38 side (+Z direction side) to the movable insulator 20. In the present embodiment, the end of the second bent portion 36 on the second engagement portion 38 side (+Z direction side) is close to or in contact with the movable insulator 20. A width of the second bent portion 36 in the Y direction is less than a width (depth) of the second fixing groove 25 in the Y direction.

As illustrated in FIG. 13, the second bent portion 36 includes a first curved portion 361, a flat portion 362, and a second curved portion 363. The first curved portion 361, the flat portion 362, and the second curved portion 363 are arranged in the +Z direction in the order as listed. A surface of the first curved portion 361 that faces the movable insulator 20 has a curved surface shape that is recessed with respect to the movable insulator 20. A surface of the flat portion 362 that faces the movable insulator 20 has a flat surface shape inclined with respect to the XY plane. A surface of the second curved portion 363 that faces the movable insulator 20 has a curved surface shape that is protruded with respect to the movable insulator 20.

The second bent portion 36 can be elastically deformed. The movable insulator 20 can be moved with respect to the fixed insulator 10 by the elastic deformation of the second bent portion 36. This reduces stress that would be generated in the mounted portion 31 and the substrate 300 when the connector 100 is connected to the other connector 200.

As illustrated in FIG. 11, the coupling portion 35 connects the first bent portion 34 and the second bent portion 36. The coupling portion 35 has a plate shape parallel to the XZ plane. A thickness direction of the coupling portion 35 is parallel to the Y direction. A surface of the coupling portion 35 that faces the movable insulator 20 has a flat surface shape parallel to the XZ plane. As illustrated in FIG. 10, a width W2 of the coupling portion 35 in the X direction is less than a width W1 of the first contact portion 30*a* in the X direction. As illustrated in FIG. 6, it is assumed that a distance in the Y direction between the coupling portion 35 and the movable insulator 20 is a distance D1. The distance D1 is longer than the distance D2. Thus, when the movable insulator 20 is moved with respect to the fixed insulator 10, the second wide portion 27 comes in contact with the fixed insulator 10 before the base 21 comes in contact with the coupling portion 35. A movement range of the movable insulator 20 is restricted by the second wide portion 27 and the fixed insulator 10.

As illustrated in FIG. 12, it is assumed that a straight line parallel to the Z direction is a reference straight line L0. It is assumed that a straight line passing through an end E1 of the first bent portion 34 on the first engagement portion 32 side and an end E2 of the first bent portion 34 on the coupling portion 35 side when viewed in the Y direction is a first straight line L1. As illustrated in FIG. 13, it is assumed that a straight line passing through an end E3 of the second bent portion 36 on the coupling portion 35 side and an end E4 of the second bent portion 36 on the second engagement portion 38 side when viewed in the Y direction is a second straight line L2. In this case, a second angle θ2 formed by the reference straight line L0 and the second straight line L2 is smaller than a first angle θ1 formed by the reference straight line L0 and the first straight line L1. The first angle θ1 and the second angle θ2 are acute angles.

Figure 14:
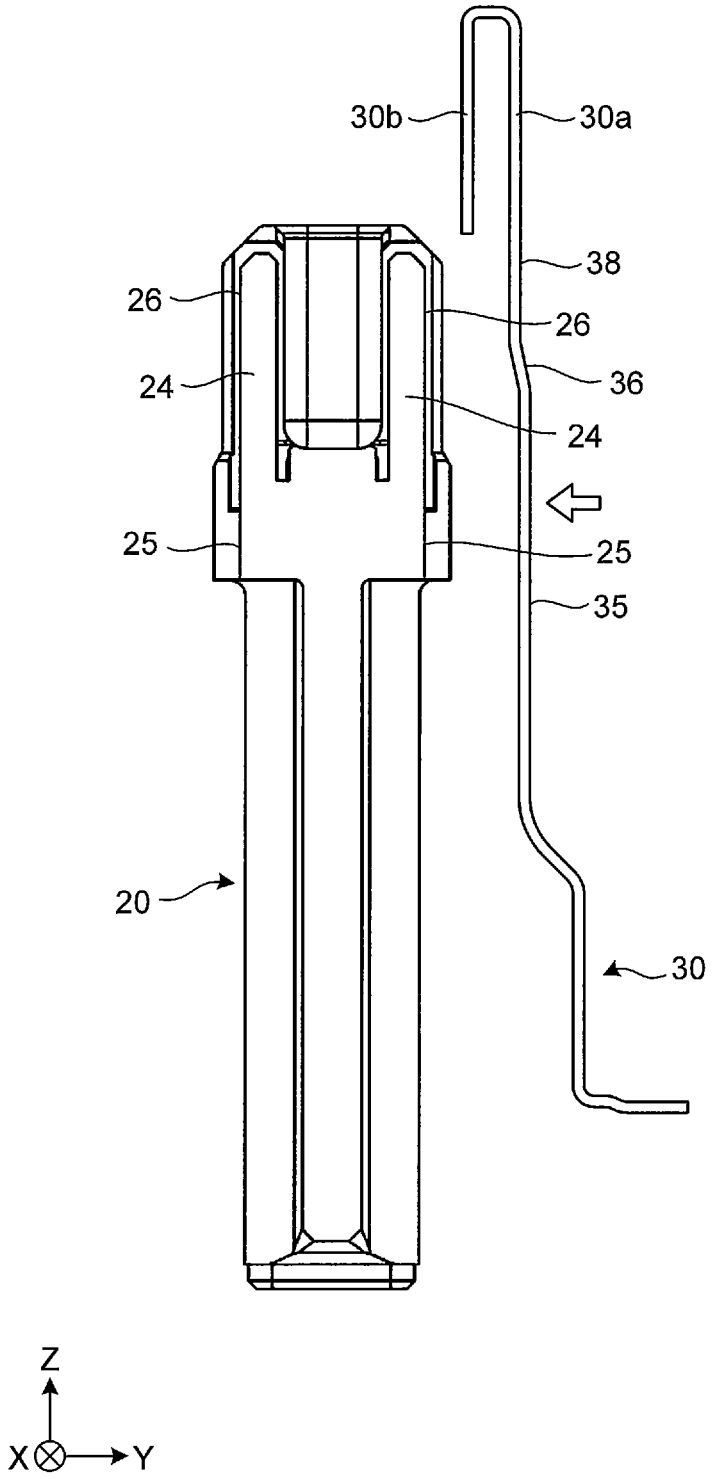
FIG. 14 is a schematic diagram for describing a manufacturing method of the connector of the embodiment.
Figure 15:
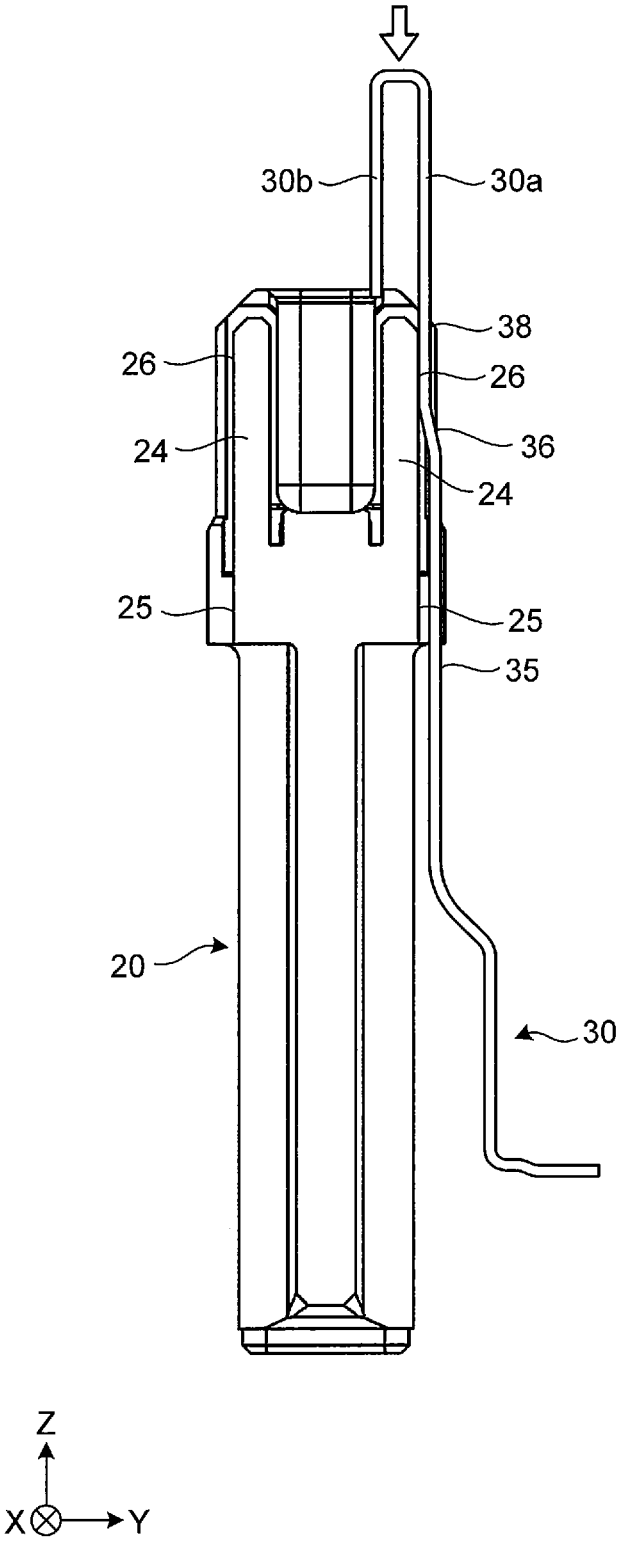
FIG. 15 is a schematic diagram for describing the manufacturing method of the connector of the embodiment.
Figure 16:
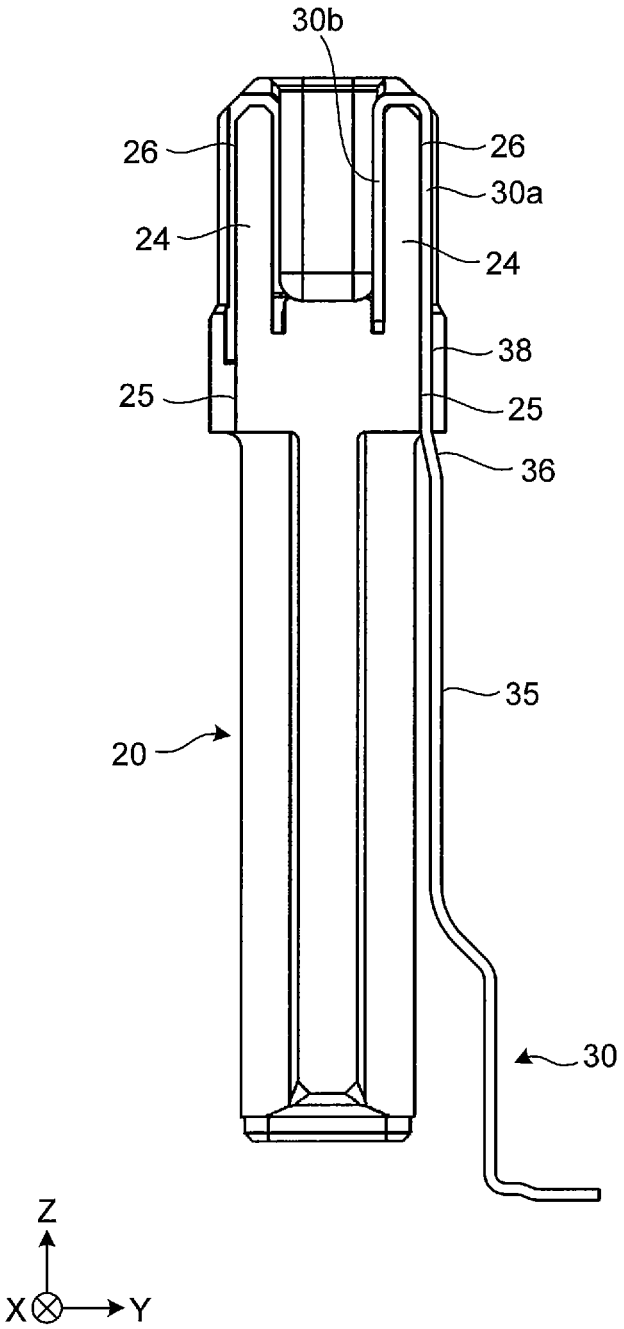
FIG. 16 is a schematic diagram for describing the manufacturing method of the connector of the embodiment.

FIG. 14 to FIG. 16 are schematic diagrams for describing a manufacturing method of the connector of the embodiment. In a manufacturing method of the connector 100, first of all, the coupling portion 35 of the contact 30 is connected into the second fixing groove 25 (first step). As illustrated in FIG. 14, the contact 30 is moved in a direction of becoming closer to the movable insulator 20 with the coupling portion 35 facing the second fixing groove 25. As a result, a state illustrated in FIG. 15 is acquired. When the first step is completed, there is a gap between the coupling portion 35 and a bottom surface of the second fixing groove 25.

After the first step, the second engagement portion 38 is inserted into the second fixing groove 25 (second step). As illustrated in FIG. 15, the contact 30 is moved in the −Z direction with the coupling portion 35 being in the second fixing groove 25. As a result, a state illustrated in FIG. 16 is acquired.

A distance between the second fixing groove 25 and the second bent portion 36 is preferably short. It is preferred that a part of the second bent portion 36 be disposed in the second fixing groove 25, or the second bent portion 36 be adjacent to the second fixing groove 25 in the Z direction.

The first bent portion 34 does not necessarily include all of the first curved portion 341, the flat portion 342, and the second curved portion 343. For example, the first bent portion 34 may include only the first curved portion 341 and the second curved portion 343 without including the flat portion 342. The second bent portion 36 does not necessarily include all of the first curved portion 361, the flat portion 362, and the second curved portion 363. For example, the second bent portion 36 may include only the first curved portion 361 and the second curved portion 363 without including the flat portion 362.

In FIG. 12, an end E1 is illustrated as an end of a surface of a first bent portion 34 that faces a fixed insulator 10, but may be another end. An end E2 is illustrated as an end of the surface of the first bent portion 34 that faces the fixed insulator 10, but may be another end. For example, an end E1 may be an end of a surface of a first bent portion 34 that faces a movable insulator 20, and an end E2 may be an end of the surface of the first bent portion 34 that faces the movable insulator 20. For example, an end E1 may be an end of a center line of a plate thickness of a first bent portion 34, and an end E2 may be an end of the center line of the plate thickness of the first bent portion 34.

In FIG. 13, the end E3 is illustrated as an end of the surface of the second bent portion 36 that faces the fixed insulator 10, but may be another end. The end E4 is illustrated as an end of the surface of the second bent portion 36 that faces the fixed insulator 10, but may be another end. For example, the end E3 may be an end of the surface of the second bent portion 36 that faces the movable insulator 20, and the end E4 may be an end of the surface of the second bent portion 36 that faces the movable insulator 20. For example, the end E3 may be an end of a center line of a plate thickness of the second bent portion 36, and an end E4 may be an end of the center line of the plate thickness of the second bent portion 36.

The contact 30 may be a fork type. A fork-type contact is a contact formed by punching a metal plate with a press. That is, the contact 30 may be formed only by a process of punching the metal plate.

As described above, the connector 100 is a connector that is connected to another connector 200. The connector 100 includes the fixed insulator 10, the movable insulator 20, and the plurality of contacts 30. The fixed insulator 10 includes the plurality of first fixing grooves 15 extending in a first direction (Z direction) and arranged in a second direction (X direction) orthogonal to the first direction. The movable insulator 20 includes the plurality of second fixing grooves 25 that extend in the first direction (Z direction) and are arranged in the second direction (X direction), is disposed inside the fixed insulator 10, and is movable with respect to the fixed insulator 10. Each of the plurality of contacts 30 is engaged with the fixed insulator 10 and the movable insulator 20 and has a first contact portion 30*a* that is in contact with the other connector 200. The contact 30 includes the first engagement portion 32 engaged with the fixed insulator 10, the second engagement portion 38 engaged with the movable insulator 20, the first bent portion 34 coupled to the first engagement portion 32 and placed between the first engagement portion 32 and the second engagement portion 38, the second bent portion 36 coupled to the second engagement portion 38 and placed on the second engagement portion 38 side with respect to the first bent portion 34, and the coupling portion 35 that couples the first bent portion 34 and the second bent portion 36. The first engagement portion 32, the first bent portion 34, the coupling portion 35, the second bent portion 36, and the second engagement portion 38 are arranged in a connecting direction in which the connector and the other connector 200 (Z direction) are connected. In an array direction in which the plurality of contacts 30 are arrayed (X direction), it is assumed that a straight line passing through the end E1 of the first bent portion 34 on the first engagement portion 32 side and the end E2 of the first bent portion 34 on the coupling portion 35 side is the first straight line L1; and it is assumed that a straight line passing through the end E3 of the second bent portion 36 on the coupling portion 35 side and the end E4 of the second bent portion 36 on the second engagement portion 38 side is the second straight line L2. In this case, the second angle θ2 formed by the second straight line L2 and the reference straight line L0 parallel to the connecting direction (Z direction) is smaller than the first angle θ1 formed by the first straight line L1 and the reference straight line L0.

When the connector 100 is being connected to the other connector 200 or in a connected state thereto, force in a direction parallel to the substrate 300 may be applied to the movable insulator 20. According to the connector 100, in a case where such force is applied, the movable insulator 20 is easily moved in parallel to the direction parallel to the substrate 300 with the end E3 of the second bent portion 36 on the coupling portion 35 side as a fulcrum. Thus, behavior of the movable insulator 20 during its movement can be stabilized when the connector 100 is being connected to the other connector 200 or in a connected state thereto.

In the connector 100, the second bent portion 36 is inclined from the movable insulator 20 toward the fixed insulator 10 in a third direction (Y direction) orthogonal to both of the first direction (Z direction) and the second direction (X direction). More specifically, a distance from the movable insulator 20 to the end E3 of the second bent portion 36 on the first engagement portion 32 side in the third direction (Y direction) orthogonal to both of the first direction (Z direction) and the second direction (X direction) is longer than a distance from the movable insulator 20 to the end E4 of the second bent portion 36 on the second engagement portion 38 side in the third direction. Thus, the movable insulator 20 and the coupling portion 35 in the connector 100 can be hampered from coming in contact with each other when the movable insulator 20 is moved with respect to the fixed insulator 10. A bend of the coupling portion 35 due to a push by the movable insulator 20 is difficult to be made when the movable insulator 20 is moved with respect to the fixed insulator 10.

In the connector 100, the end E4 of the second bent portion 36 on the second engagement portion 38 side is disposed in the second fixing groove 25. Thus, when the movable insulator 20 is moved, force in the movement is easy to be applied to the end E4 of the second bent portion 36 on the second engagement portion 38 side. Thus, the movable insulator 20 is more easily moved in parallel to a direction parallel to the substrate 300 by the second bent portion 36.

In the connector 100, the contact 30 is formed by bending a plate material. This makes it easier for the contact 30 to move in the third direction (Y direction).

In the connector 100, the contact 30 includes the first contact portion 30*a* that comes in contact with a contact 90 of the other connector 200. The width W2 of the coupling portion 35 in the second direction (X direction) is less than the width W1 of the first contact portion 30*a* in the second direction. With this configuration, when the contact 30 is attached to the movable insulator 20, the coupling portion 35 can be easily inserted into the second fixing groove 25. Thus, the contact 30 can be connected into the movable insulator 20 in a state in which the coupling portion 35 is guided by the second fixing groove 25. Consequently, it is easy to assemble the movable insulator 20 and the contact 30 of the connector 100.

In the connector 100, the contact 30 includes the first contact portion 30*a* disposed on one side of the movable insulator 20 and a second contact portion 30*b* disposed on the other side of the movable insulator 20. The first contact portion 30*a* and the second contact portion 30*b* are in contact with the contact 90 of the other connector 200. With this configuration, the contact 30 of the connector 100 is in contact with the contact 90 of the other connector 200 at two points. Consequently, the connector 100 can hamper conduction failure between the substrate 300 and the substrate 400.

A manufacturing method of the connector 100 includes a first step of connecting the coupling portions 35 into the second fixing grooves 25, and a second step of inserting the second engagement portions 38 into the second fixing grooves 25 after the first step.

In a manufacturing process of contacts, spaces between the contacts may vary after a metal plate is punched by a press. Specifically, at ends of the contacts on a side opposite to a carrier for transporting the contacts, spaces between adjacent contacts are likely to vary. In this case, when the contacts are connected to a movable insulator 20, deviations from correct positions in fixing grooves into which the contacts are originally inserted may be occur. By contrast, according to the manufacturing method of the connector 100 of the present embodiment, since the coupling portions 35 are guided to the second fixing grooves 25 in the first step, spaces between the contacts 30 are easy to be equal. Thus, the positions of the first contact portions 30*a* and the second contact portions 30*b* in the X direction are hampered from deviating from the correct positions during the second step. Thus, the first contact portions 30*a* and the second contact portions 30*b* are supported at correct positions in the holding grooves 26. Consequently, with the manufacturing method of the connector 100, the movable insulator 20 and the contacts 30 can be assembled easily.

The invention claimed is:

1. A connector that is connected to another connector, comprising:

a fixed insulator that is provided with a plurality of first fixing grooves extending in a first direction and arranged in a second direction orthogonal to said first direction;

a movable insulator that is provided with a plurality of second fixing grooves extending in said first direction and arranged in said second direction, that is disposed inside said fixed insulator, and that is movable with respect to said fixed insulator; and a plurality of contacts that are engaged with said fixed insulator and said movable insulator and each of which includes a first contact portion that is in contact with said other connector, wherein each of said contacts includes a first engagement portion engaged with said fixed insulator, a second engagement portion engaged with said movable insulator, a first bent portion that is coupled to said first engagement portion and is placed between said first engagement portion and said second engagement portion, a second bent portion that is coupled to said second engagement portion and is placed on said second engagement portion side with respect to said first bent portion, and a coupling portion that couples said first bent portion and said second bent portion, wherein said first engagement portion, said first bent portion, said coupling portion, said second bent portion, and said second engagement portion are arranged in a connecting direction in which said connector and said other connector are connected, a second angle formed by a second straight line and a reference straight line parallel to said connecting direction is smaller than a first angle formed by a first straight line and said reference straight line, where said first straight line is a straight line passing through an end of said first bent portion on said first engagement portion side and an end of said first bent portion on said coupling portion side in an array direction in which said contacts are arrayed, and said second straight line is a straight line passing through an end of said second bent portion on said coupling portion side and an end of said second bent portion on said second engagement portion side in said array direction, and said first bent portion and said second bent portion are inclined with respect to a third direction orthogonal to both of said first direction and said second direction.

2. The connector according to claim 1, wherein a distance in said third direction from an end of said second bent portion on said first engagement portion side to said movable insulator is longer than a distance in said third direction from an end of said second bent portion on said second engagement portion side to said movable insulator.

3. The connector according to claim 1, wherein the end of said second bent portion on said second engagement portion side is disposed in said second fixing groove.

4. The connector according to claim 1, wherein said contacts are formed by bending a plate material.

5. The connector according to claim 1, wherein each of said contacts includes a first contact portion that is in contact with a contact of said other connector, and a width of said coupling portion in said second direction is less than a width of said first contact portion in said second direction.

6. The connector according to claim 1, wherein each of said contacts includes a first contact portion disposed on one side of said movable insulator and a second contact portion disposed on the other side of said movable insulator, and said first contact portion and said second contact portion are in contact with a contact of said other connector.

7. A manufacturing method of a connector that is connected to another connector and includes a fixed insulator that is provided with a plurality of first fixing grooves extending in a first direction and arranged in a second direction orthogonal to said first direction, a movable insulator that is provided with a plurality of second fixing grooves extending in said first direction and arranged in said second direction, that is disposed inside said fixed insulator, and that is movable with respect to said fixed insulator, and a plurality of contacts that are engaged with said fixed insulator and said movable insulator and each of which includes a contact portion that is in contact with said other connector, each of said contacts including a first engagement portion engaged with said fixed insulator, a second engagement portion engaged with said movable insulator, a first bent portion that is coupled to said first engagement portion and is placed between said first engagement portion and said second engagement portion, a second bent portion that is coupled to said second engagement portion and is placed on said second engagement portion side with respect to said first bent portion, and a coupling portion that couples said first bent portion and said second bent portion, said first engagement portion, said first bent portion, said coupling portion, said second bent portion, and said second engagement portion being arranged in a connecting direction in which said connector and said other connector are connected, and a second angle formed by a second straight line and a reference straight line parallel to said connecting direction being smaller than a first angle formed by a first straight line and said reference straight line, where said first straight line is a straight line passing through an end of said first bent portion on said first engagement portion side and an end of said first bent portion on said coupling portion side in an array direction in which said contacts are arrayed, and said second straight line is a straight line passing through an end of said second bent portion on said coupling portion side and an end of said second bent portion on said second engagement portion side in said array direction, said manufacturing method comprising:

a first step of connecting said coupling portions into said second fixing grooves; and a second step of inserting said second engagement portions into said second fixing grooves after said first step.

8. A connector that is connected to another connector, comprising:

a fixed insulator that is provided with a plurality of first fixing grooves extending in a first direction and arranged in a second direction orthogonal to said first direction;

a movable insulator that is provided with a plurality of second fixing grooves extending in said first direction and arranged in said second direction, that is disposed inside said fixed insulator, and that is movable with respect to said fixed insulator; and a plurality of contacts that are engaged with said fixed insulator and said movable insulator and each of which includes a first contact portion that is in contact with said other connector, wherein each of said contacts includes a first engagement portion engaged with said fixed insulator, a second engagement portion engaged with said movable insulator, a first bent portion that is coupled to said first engagement portion and is placed between said first engagement portion and said second engagement portion, a second bent portion that is coupled to said second engagement portion and is placed on said second engagement portion side with respect to said first bent portion, and a coupling portion that couples said first bent portion and said second bent portion, said first engagement portion, said first bent portion, said coupling portion, said second bent portion, and said second engagement portion are arranged in a connecting direction in which said connector and said other connector are connected, and a second angle formed by a second straight line and a reference straight line parallel to said connecting direction is smaller than a first angle formed by a first straight line and said reference straight line, where said first straight line is a straight line passing through an end of said first bent portion on said first engagement portion side and an end of said first bent portion on said coupling portion side in an array direction in which said contacts are arrayed, and said second straight line is a straight line passing through an end of said second bent portion on said coupling portion side and an end of said second bent portion on said second engagement portion side in said array direction, wherein each of said contacts includes a first contact portion disposed on one side of said movable insulator and a second contact portion disposed on the other side of said movable insulator, and said first contact portion and said second contact portion are in contact with a contact of said other connector.

9. The connector according to claim 8, wherein said second bent portion is inclined from said movable insulator toward said fixed insulator in a third direction different than both of said first direction and said second direction.

10. The connector according to claim 8, wherein said contacts are formed by bending a plate material.

11. The connector according to claim 8, wherein each of said contacts includes a first contact portion that is in contact with a contact of said other connector, and a width of said coupling portion in said second direction is less than a width of said first contact portion in said second direction.

12. The connector according to claim 8, wherein the end of said second bent portion on said second engagement portion side is disposed in said second fixing groove.

* * * * *